United States Patent [19]

Ackley

[11] Patent Number: 4,528,904

[45] Date of Patent: Jul. 16, 1985

[54] INK RESERVOIR REMOVING AND INSERTING STRUCTURE FOR ARTICLE MARKING APPARATUS

[76] Inventor: E. Michael Ackley, 1273 N. Church St., Moorestown, N.J. 08057

[21] Appl. No.: 544,509

[22] Filed: Oct. 24, 1983

[51] Int. Cl.[3] ..... B41F 17/36

[52] U.S. Cl. ..... 101/35; 101/218; 101/248; 101/364

[58] Field of Search ..... 101/35, 36, 37, 40, 101/218, 217, 216, 212, 142, 150, 153, 154, 248, 364, 363

[56] References Cited

U.S. PATENT DOCUMENTS

| | | | |
|---|---|---|---|
| 1,590,742 | 6/1926 | Goulding | 101/218 |
| 2,859,689 | 11/1958 | Ackley | 101/35 |
| 3,073,240 | 1/1963 | Tyma, Jr. et al. | 101/364 X |
| 3,272,118 | 9/1966 | Ackley | 101/37 |
| 3,443,516 | 5/1969 | Schnall | 101/218 |
| 4,193,343 | 3/1980 | Ackley, Sr. et al. | 101/154 X |

*Primary Examiner*—Clifford D. Crowder
*Attorney, Agent, or Firm*—Weiser & Stapler

[57] ABSTRACT

Printing apparatus for marking small articles in which a printing head (24) having a design roll (26) and a printing roll (30), mounted for rotation about parallel axes (28,32), is movable between an operative position in which the printing roll prints indicia on the articles and a dwell position in which the printing roll is spaced from the articles. The movement of the printing head between the operative and dwell position is pivotal about the design roll rotation axis.

16 Claims, 7 Drawing Figures

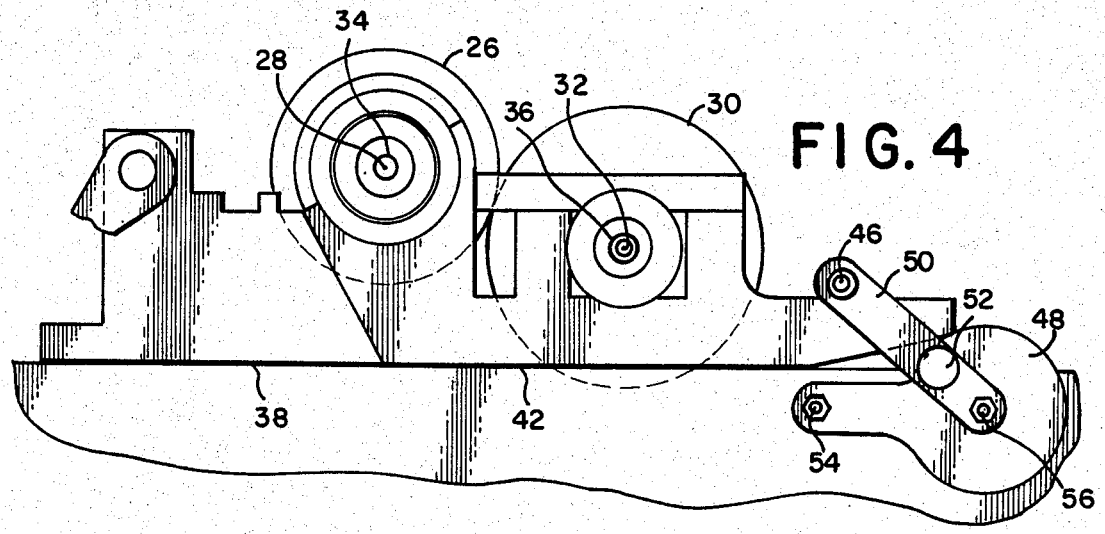
FIG. 4
FIG. 5
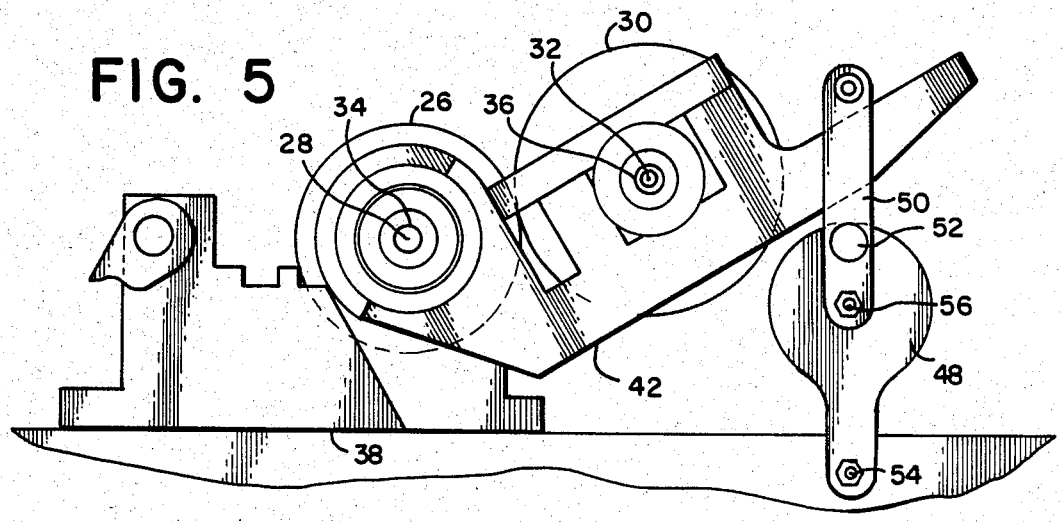
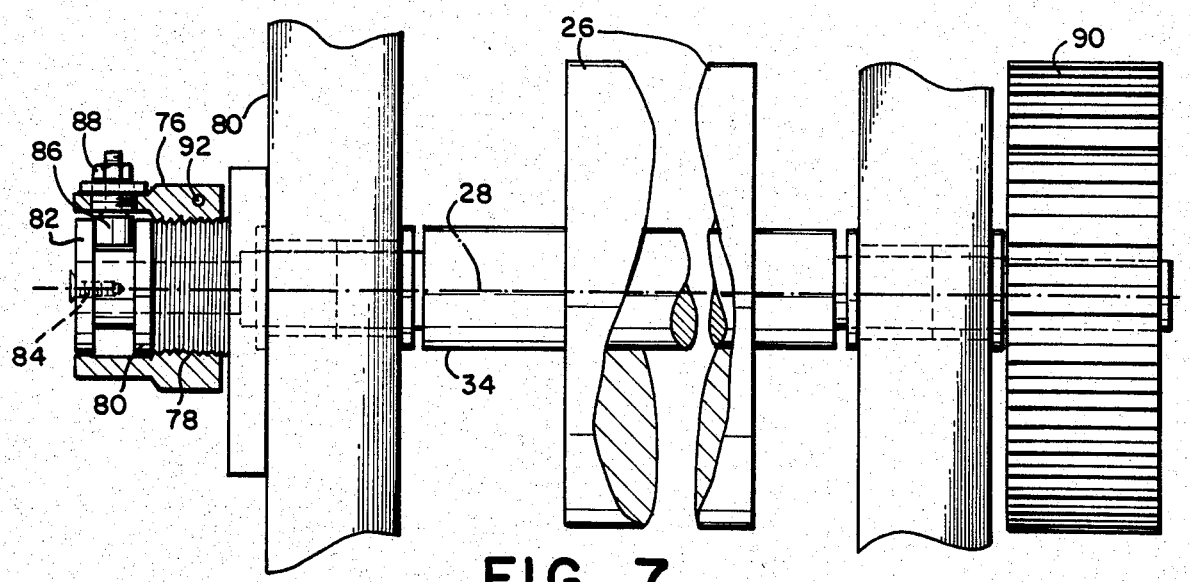
FIG. 7

INK RESERVOIR REMOVING AND INSERTING STRUCTURE FOR ARTICLE MARKING APPARATUS

DESCRIPTION

1. Technical Field

The present invention relates, in general, to apparatus for printing indicia on articles and, in particular, to printing apparatus which marks articles by means of a printing roll to which ink is transferred from a design roll.

2. Background Art

Small articles, such as pieces of candy and pharmaceutical capsules and tablets, often are marked with indicia, such as trademarks, lot numbers and the like. A very commonly used printer which effects such marking includes a design roll which is etched with the desired indicia and a printing roll which marks the articles. The etched portions of the design roll pick up marking ink from a reservoir as the design roll passes through the reservoir. The ink is transferred from the design roll to the printing roll as the two rolls contact one another and the printing roll, in turn, prints the indicia on the articles. U.S. Pat. No. 4,193,343 shows such a printer.

Commercially available printers of this type suffer from one or more shortcomings. For example, the location of the ink reservoir makes it difficult to remove or reinsert the reservoir when the ink supply must be replenished or the surrounding parts must be replaced or repaired. Ink spillage may occur.

U.S. Pat. No. 4,193,343 recognizes the problems of accessibility and movement of the ink reservoir. This patent discloses a movable printing head which is intended to solve these and related problems. By moving the design roll and the printing roll away from the conveyor which carries the articles to be marked, the ink reservoir is accessible for removal and easier to replace in the unit than for a printer having a stationary printing head.

The solution offered by U.S. Pat. No. 4,193,343, however, is inadequate. First, in the unit described and illustrated in U.S. Pat. No. 4,193,343, the ink reservoir is removed and reintroduced at the middle of the machine, whereby there remains some difficulty in the handling of the ink reservoir, particularily when the reservoir is filled with ink. The hazzard of ink spillage still exists because the space for manipulating the ink reservoir into position is limited.

In addition, the particular pivoting arrangement in U.S. Pat. No. 4,193,343 makes difficult the fine settings and adjustments which must be made to the design roll and the printing roll to accommodate different thickness articles. The liftable printing head in U.S. Pat. No. 4,193,343 is pivotted between an operative position in which the printing roll is in position to contact the articles to be marked and a dwell position in which the printing roll is spaced from the articles to be marked. The rotation axes of the design roll and the printing roll are located, relative to the pivot axis of the printing head, such that as the rotation axis of the printing roll is adjusted to accommodate different thickness articles to be marked, the rotation axis of the design roll also must be adjusted to maintain its proper position in the ink reservoir. At the same time, it is necessary to maintain the contact between the design roll and the printing roll, so that ink may be transferred from the design roll to the printing roll. It is apparent that the setting of the rolls, relative to one another and relative to the conveyor carrying the articles to be marked, can be a difficult and time consuming task.

DISCLOSURE OF THE INVENTION

Accordingly, it is an objective of the present invention to provide new and improved apparatus for printing indicia on articles.

It is another objective of the present invention to provide printing apparatus which permits easy handling of an ink reservoir and reduces greatly the hazzard of ink spillage as the reservoir is removed from or introduced into the apparatus.

It is a further objective of the present invention to provide printing apparatus which is adapted to handle articles of different thickness by relatively simple adjustments of the design roll and the printing roll.

Printing apparatus for marking articles, constructed in accordance with the present invention, includes conveying means for moving articles along a predetermined path and a printing head mounted for pivotal movement about a pivot axis between a first position in which indicia are printed on the articles and a second position in which the printing head is spaced from the articles. The printing head has a rotatable design roll mounted for rotation about the pivot axis of the printing head and a rotatable printing roll mounted for rotation about a second axis parallel to the pivot axis of the printing head. The rotation axes of the design roll and printing roll are spaced apart, so that they make tangential contact with each other, whereby ink carried on the design roll is transferred to the printing roll. The printing apparatus of the invention also includes an ink reservoir positioned beneath the design roll and above the conveying means and through which the design roll passes to pick up ink.

BRIEF DESCRIPTION OF THE DRAWINGS

Referring to the drawings:

FIGS. 4 and 5 are side views which show the manner in which the printing head of the present invention is pivoted into and out of the operative printing position;

FIG. 7 is a sectional view showing the mechanism for transverse settings of the design roll to locate indicia on the articles to be marked.

BEST MODE OF CARRYING OUT THE INVENTION

Figure 1:
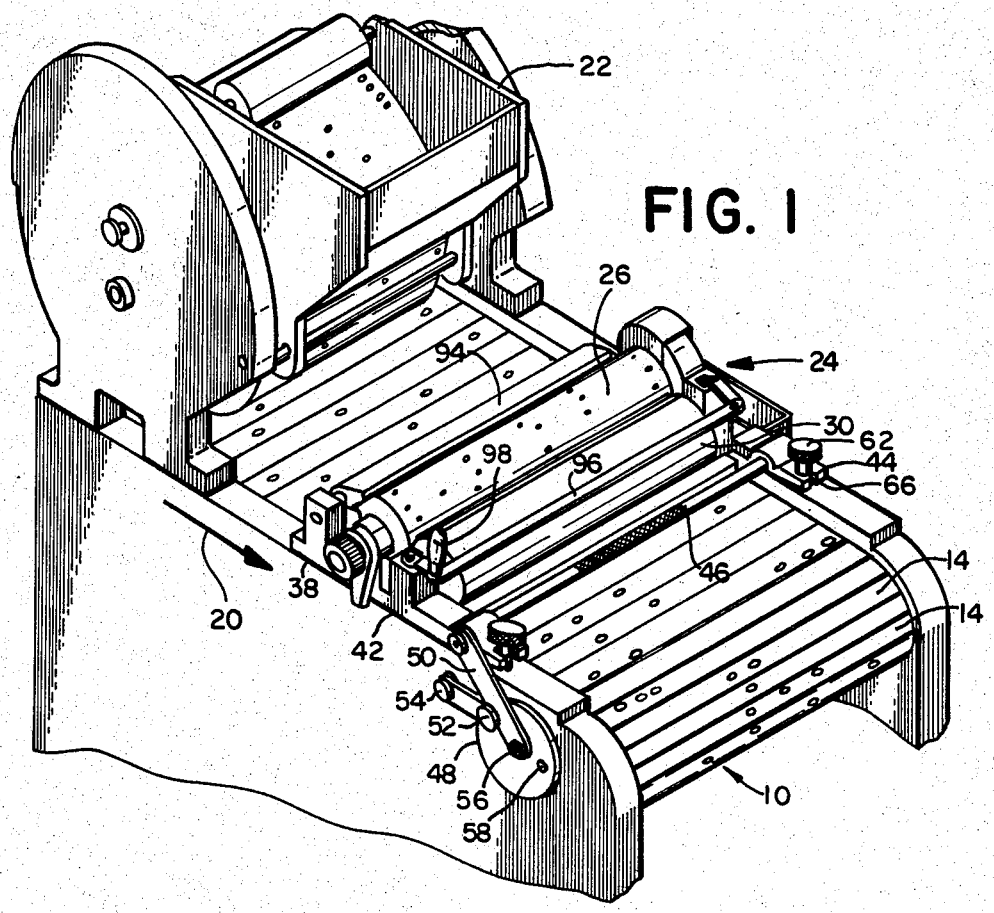
FIG. 1 is a perspective view of printing apparatus constructed in accordance with the present invention.

Referring to FIGS. 1–5, printing apparatus for marking articles, constructed in accordance with the present invention, includes conveying means 10 for moving articles 12 to be marked along a predetermined path. Although these articles will be referred to as pharmaceutical tablets in this description of the invention, other articles, such as pharmaceutical capsules and pieces of candy, also may be marked by printing apparatus constructed in accordance with the invention.

The conveying means which carry tablets 12 may include an endless conveyor formed by a plurality of carrier bars 14 each having a plurality of tablet pockets 16 within which tablets 12 are carried. Tablet pockets 16 are arranged in a suitable, uniform pattern, so that tablets 12 are presented for marking in a uniform pattern.

Conveyor 10 is driven by suitable means, including a drive wheel 18, and moves in the direction of arrows 20. Tablets 12 which are to be marked are deposited in a hopper 22 of conventional construction and operation which supplies the tablets to pockets 16 of the conveyor in the usual way.

Printing apparatus, constructed in accordance with the present invention, also includes a printing head 24 which is mounted for pivotal movement between a first position in which indicia are printed on tablets 12 and a second position in which the printing head is spaced from tablets 12. The printing head is shown in the first or operative position in FIGS. 1 and 4, in solid lines in FIG. 3, and in broken lines in FIG. 2 and in the second or dwell position in FIG. 5, in solid lines in FIG. 2, and in broken lines in FIG. 3.

Printing head 24 includes a rotatable design roll 26 mounted for rotation about a first horizontal axis 28 and a rotatable printing roll 30 mounted for rotation about a second horizontal axis 32 parallel to axis 28 and spaced from axis 28, so that rolls 26 and 30 make tangential contact. Design roll 26 is mounted for rotation on a shaft 34, while printing roll 30 is mounted for rotation on a shaft 36.

FIGS. 4 and 5 show the components which effect movement of the printing head between the operative position in which indicia are printed on the tablets and the dwell position in which the printing roll is spaced from conveyor 10. Located along opposite sides of the apparatus are two pairs of side frames 38,40, and 42,44. Side frames 38 and 40 are secured to the main structure of the apparatus and are stationary. Shaft 34 which carries design roll 26 is positioned in side frames 38 and 40.

Side frames 42 and 44 are mounted for pivotal movement about axis 28 of shaft 34. Shaft 36 which carries printing roll 30 is positioned in side frames 42 and 44. As side frames 42 and 44 are pivoted about axis 28 of shaft 34, printing roll 30 is moved away from or towards conveyor 10. A tie bar 46, which extends between side frames 42 and 44, serves as a handle for lifting or dropping printing roll 30.

Figure 2:
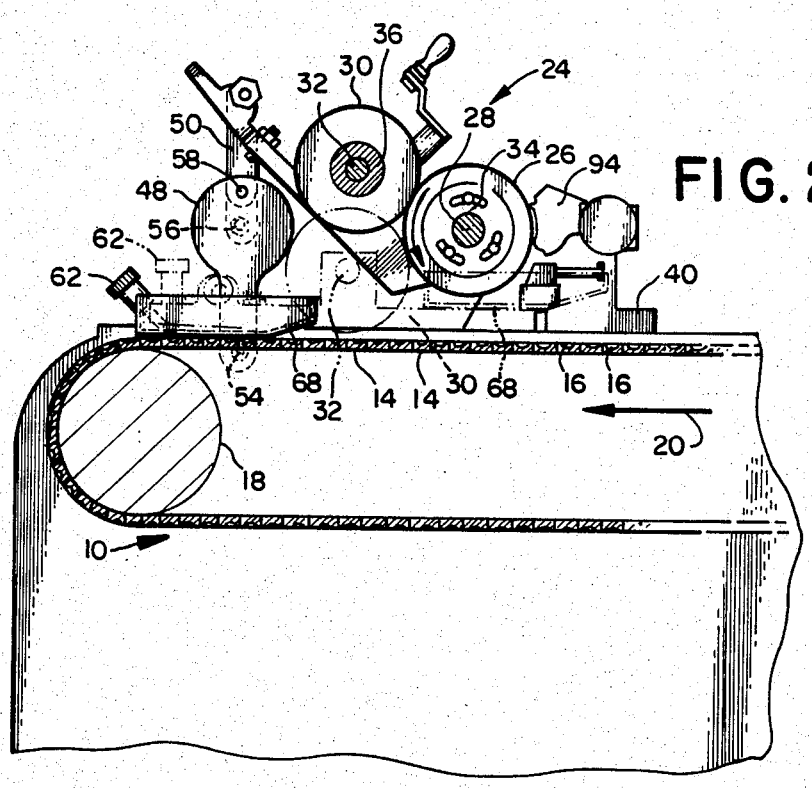
FIG. 2 is a side view, partially in section, of the apparatus of FIG. 1.
Figure 3:
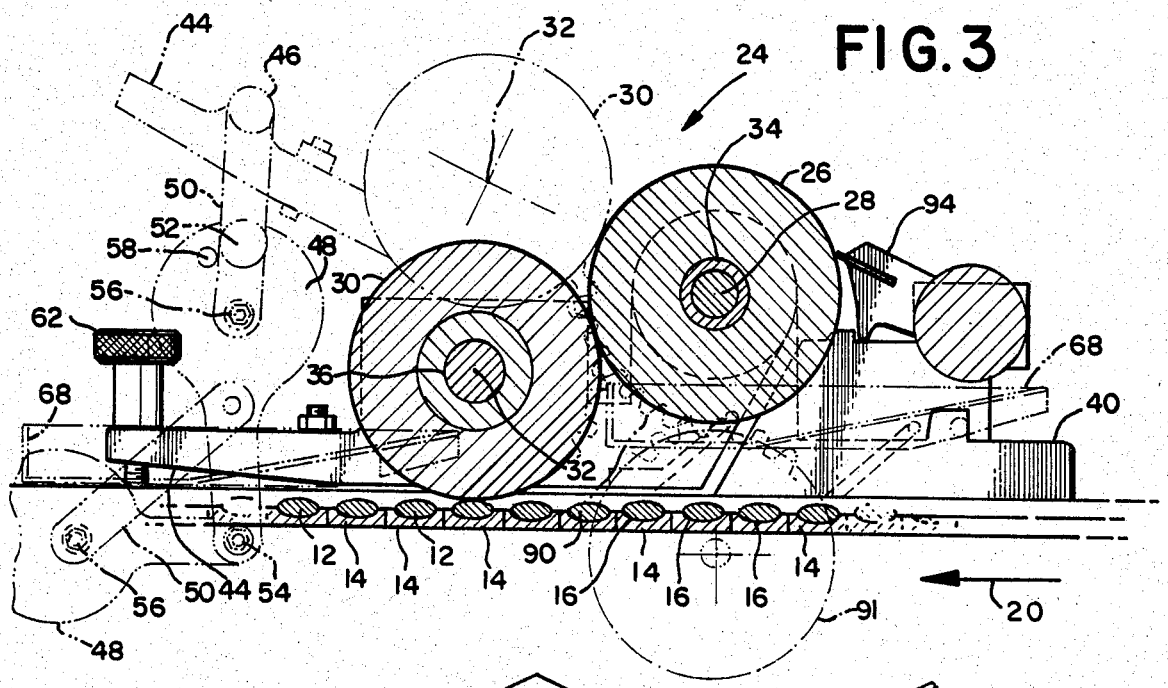
FIG. 3 is an enlarged view of a portion of the apparatus shown in FIG. 3.

A hinge mechanism, composed of a paddle-shaped primary hinge bar 48, a lock hinge bar 50 and a spring loaded plunger 52 carried on the lock hinge bar, serve to lock printing roll 30 in the dwell position. As tie bar 46 is raised, primary hinge bar 48 pivots about a pivot stud 54 secured to the main structure of the apparatus and lock hinge bar 50, secured at one end to primary hinge bar 48 by a lock stud 56, pivots about tie bar 46 carried on pivotal side frames 42 and 44. When tie bar 46 is raised to its highest position as shown in FIGS. 2 and 5, a through hole 58 in primary hinge bar 48 is aligned with spring loaded plunger 52 carried on lock hinge 50 and the plunger enters through hole 58 to lock the printing head in the dwell position. In order to return the printing head to the operative position to print indicia on the tablets, plunger 52 is pulled against the action of its spring to retract the plunger from through hole 58 and tie bar 46 is pushed downward. FIG. 3 shows the printing head almost at the dwell position with through hole 58 in primary hinge bar 48 just to the side of lock hinge bar 50 and spring loaded plunger 52.

A pair of lock down knobs 60 and 62 serve to hold the printing head in place for applying indicia to the tablets. Each of these knobs is arranged for axial movement as the knob is turned and each is mounted, at its point end, for pivotal movement in a pair of slots 64 and 66 in pivotal side frames 42 and 44, respectively. After knobs 60 and 62 are turned, so that they move upward enough to clear the ends of pivotal side frames 42 and 44 when they are pivoted though slots 64 and 66 in pivotal side frames 42 and 44, such as shown for knob 62 in FIG. 2, these side frames are free to move upward when tie bar 46 is moved upward. When the printing head is returned to the operative position, knobs 60 and 62 are swung into slots 64 and 66, respectively, and turned down to lock the printing head in the operative position. The desired contact between printing roll 30 and tablets 12 is determined by the settings of knobs 60 and 62, in that the knobs bear against the top surfaces of pivotal side frames 42 and 44 to locate the position of printing roll 30. In this way, different thickness tablets may be marked by the apparatus.

Figure 6:
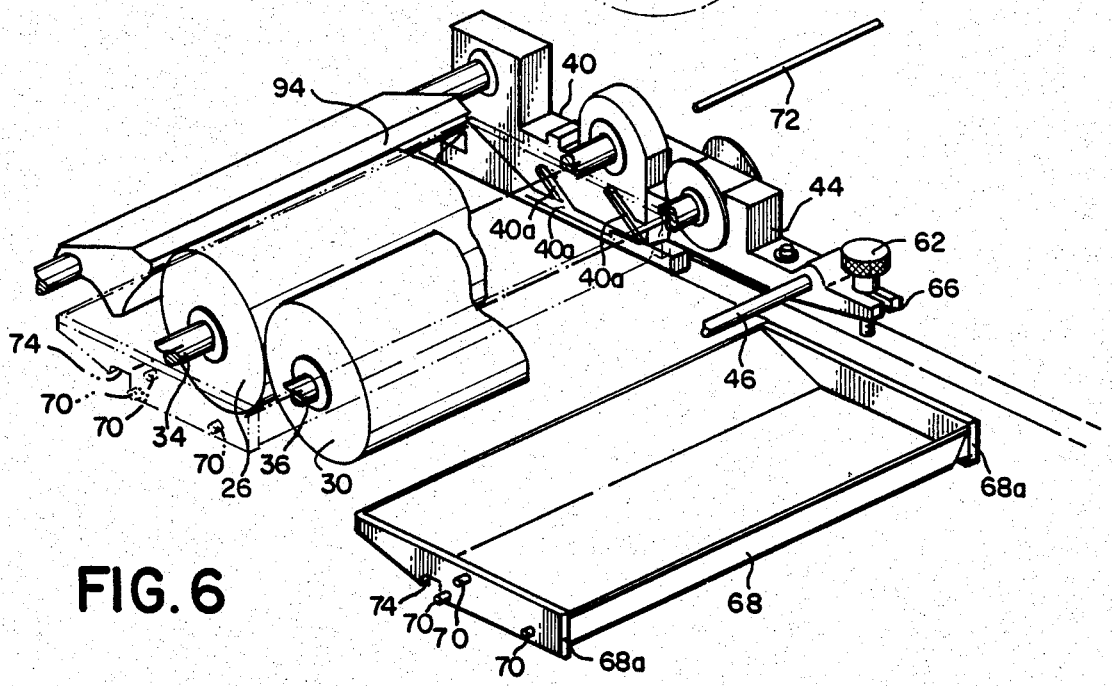
FIG. 6 is an enlarged perspective view of a portion of the apparatus shown in FIG. 1 which illustrates the manner in which an ink reservoir is removed from and introduced into the apparatus.

Printing apparatus, constructed in accordance with the present invention, further includes an ink reservoir, in the form of a tray 68, positioned beneath design roll 26 and above conveyor 10. Referring to FIG. 6, ink tray 68 may be removed by first loosening lock down knobs 60 and 62 (only knob 62 is shown in FIG. 6), then swinging knob 62 out of slot 66 in pivotal side frame 44, then raising the printing head to the dwell position by pulling up on tie bar 46, and then sliding the ink tray from the position shown in broken lines to the position shown in solid lines. Ink tray 68 has three lugs 70 on each sidewall **68*a* which are adapted to engage grooves cut into each of the stationary side frames 38 and 40 (only stationary side frame 40 is shown in FIG. 6). As ink tray 68 is introduced beneath the raised printing head and lugs 70 engage grooves 40*a* in stationary side frame 40 and similar grooves in stationary side frame 38, the ink tray is guided into position beneath design roll 26 and above conveyor 10. The upwardly inlined grooves 40*a* elevate ink tray 68 to its proper position relative to design roll 26. When printing roll 30 is returned to the operative position, axis 32 of the printing roll is positioned below axis 28 of the design roll. A locking pin 72, inserted through aligned holes in stationary side frames 38 and 40 and notches 74 in sidewalls 68*a* of ink tray 68**, retains the ink tray in the desired position.

By positioning design roll 26 between hopper 22 and liftable printing roll 30, ink tray 68 may be manipulated into and out of its position beneath the design roll and above conveyor 10 more easily than if the positions of the two rolls were reversed and the liftable printing roll was positioned between hopper 22 and design roll 26. Moving the ink tray from the front of the unit instead of in the middle provides greater access and reduces the tendency to spill ink from the ink tray.

It is particularily important to note that by selecting axis 28 of shaft 34 as the pivot axis about which pivotal side frames 42 and 44 and printing roll 30 are pivoted, design roll 26 maintains its position in ink tray 68 and the tangential contact between printing roll 30 and design roll 26 is maintained for all positions of the printing roll. As a result, when the position of printing roll 30 is set by adjustment of knobs 60 and 62 to accommodate a selected tablet thickness, the contact between design roll 26 and printing roll 30 already is set.

In contrast, for a unit having a different pivot axis, such as the one shown in U.S. Pat. No. 4,193,343, the position of the design roll in the ink reservoir is changed as the position of the printing roll is changed. This may position the design roll above the ink level in ink tray 68, in which case the design roll does not pick up ink, or it may cause the design roll to brush against the bottom surface of the ink tray, thereby damaging the design roll. As a result, the position of the design roll must be reset. Upon repositioning the design roll properly within the ink reservoir in U.S. Pat. No. 4,193,343, the contact between the design roll and the printing roll is altered requiring repositioning of the two to satisfy concurrently the thickness of the tablet being marked, the position of the design roll in the ink reservoir and the contact between the design roll and the printing roll. Maintaining proper contact between the two rolls is important in locating the indicia on the articles being marked and also in transferring the amount of ink from the design roll to the rubber roll.

Producers of pharmaceutical products and similar articles are particularly concerned with the appearance and proper positioning of the indicia on these articles. In locating the indicia, it is necessary to set the design roll with respect to both the direction of movement of the conveyor carrying the articles to be marked and the transverse direction. The present invention contemplates using currently employed mechanisms and techniques for achieving correct registration of the indicia with respect to the direction of movement of the conveyor. As to achieving correct registration of the indicia in the transverse direction, FIG. 7 shows a preferred mechanism which may be employed.

Design roll 26 may be moved back and forth along the axis 28 of shaft 34 by turning an internally threaded split knob 76 which engages an externally threaded journal 78 attached to the outside surface 80 of the frame of the apparatus. A spool 82 is positioned within knob 76 at the outside surface of journal 78. Spool 82 is fastened to shaft 34 by means of a screw 84. Knob 76 is coupled to spool 82 by means of a screw 86 and a nut 88. Knob 76 is split axially along its length in the region of its internal thread.

After spool 80 is positioned within knob 76, the head of screw 86 is passed through a threaded, radial hole in knob 76, so that the head of screw 86 fits into the groove of the spool. Next, nut 88, having an internal thread which engages screw 86 and an external thread which engages the threaded, radial hole in knob 76, is turned onto screw 86 and into the threaded radial hole to couple knob 76 to spool 82.

As knob 76 is turned on journal 78, the knob moves toward or away from surface 80 of the frame, depending upon the direction of rotation of the knob. The knob, in turn, moves spool 80 along the axis of shaft 34 which moves with spool 80, thereby moving design roll 26, secured to shaft 34, along the axis of shaft 34. By providing the drive gear 90, which turns shaft 34 with straight teeth which extend parallel to the axis of shaft 34, the transverse setting of design roll 26 may be established while conveyor 10 and design roll 26 are in motion. Gear 90 simply moves along axis 28 varying its engagement with drive gear 91 shown in FIG. 3 as knob 76 is turned. Once the design roll position is set, the design roll may be locked in place by tightening a screw 92 which pinches the split section of knob 76 on journal 78.

In addition to the foregoing, printing apparatus, constructed in accordance with the present invention, further includes various other components and assemblies normally provided in such equipment. For example, a doctor blade 94 serves to remove excess ink from design roll 26. Also, a link 96, actuated by a handle 98, is coupled to printing roll 30 for moving the printing roll into and out of engagement with design roll 26. In commercially available equipment, the design roll is moved to disengage the design roll and the printing roll. In the present invention, the printing roll is moved because the design roll shaft serves as the pivot axis for moving the printing head. However, the mechanism for disengaging the printing roll and the design roll according to the present invention may be similar to the mechanism used in commercially available units.

While in the foregoing there has been described a preferred embodiment of the present invention, it should be understood to those skilled in the art that various modifications and changes can be made without departing from the true spirit and scope of the invention as recited in the claims.

What is claimed is:

1. Printing apparatus for marking articles comprising:

(A) conveying means for moving articles received from a supply means along a generally horizontal, predetermined path to a print means comprising:

(1) a rotatable design roll;

(2) first mounting means for mounting said design roll for rotation about a first horizontal axis which is generally parallel to said conveying means and generally perpendicular to said predetermined path;

(3) a rotatable printing roll positioned on a side of the design roll which is opposite to the supply means;

(4) second mounting means for mounting said printing roll for rotation about a second horizontal axis parallel to said first horizontal axis; and (5) pivot means for:

(a) fixing the position of said first and said second mounting means so that the distance between said first and said second horizontal axes is always equal to the radius of said design roll plus the radius of said printing roll and so that said rolls are maintained in tangential contact with each other irrespective of positioning, and (b) selectively pivoting said printing roll and said second mounting means about said design roll and said first horizontal axis between an operative position in which said printing roll is in position to contact articles on said conveying means and a dwell position in which said printing roll is spaced from said conveying means so as not to contact articles on said conveying means; and (B) an ink reservoir positioned directly beneath said design roll and directly over said conveying means;

(C) wherein said means for fixing the position of said first and said second mounting means incorporates means for guiding movement of said ink reservoir to and from the position directly under said design roll and directly above said conveying means, in the general direction of said printing roll, and for permitting said ink reservoir to be removed from said printing apparatus from the side of said design roll which is opposite to the supply means.

2. Printing apparatus according to claim 1 wherein said second horizontal axis is below said first horizontal axis when said printing roll and said second mounting means are in said operative position.

3. Printing apparatus according to claim 1 wherein said pivot means include a pair of stationary side frames within which said first mounting means are positioned.

4. Printing apparatus according to claim 3 wherein said side frames include means for guiding movement of said ink reservoir to and from beneath said design roll, and wherein said guiding means permits said ink reservoir to be removed from between said side frames and said printing apparatus.

5. Printing apparatus according to claim 1 wherein said pivot means include a pair of pivotal side frames mounted for pivotal movement about said first horizonal axis and within which said second mounting means are positioned.

6. Printing apparatus according to claim 5 which further comprises a hinge mechanism connecting an end of said pivotal side frames opposite to said pivotal mounting and the frame of said printing apparatus, comprising:

a first hinge bar pivotally associated with the end of said pivotal side frame;

a second hinge bar pivotally associated with the frame of said printing apparatus and said first hinge bar; and hinge locking means operatively associated with said first and second hinge bars, for retaining said pivot means in said dwell position.

7. Printing apparatus according to claim 6 which further comprises a lift bar connected to and between ends of said pivotal side frames opposite to said pivotal mounting.

8. Printing apparatus according to claim 5 which further comprises means for locking said pivotal means in said operative position.

9. Printing apparatus according to claim 8 wherein said locking means enables adjustment of contact between said printing roll and said articles when said pivot means is in said operative position.

10. Printing apparatus according to claim 9 wherein said locking means comprises a lock down knob pivotally associated with the frame of said apparatus and adapted to engage a slot in an end of the pivotal side frames opposite to the pivotal mounting.

11. Printing apparatus according to claim 10 wherein a lock down knob is associated with each of said pivotal side frames.

12. Printing apparatus according to claim 1 wherein said first mounting means include a rotatable shaft to which said design roll is secured and said pivot means include a pair of stationary side frames within which said rotatable shaft is positioned for rotary movement and transverse movement along the axis of said shaft.

13. Printing apparatus according to claim 12 further including a drive gear having straight teeth which extend parallel to said axis of said rotatable shaft and secured to said rotatable shaft.

14. Printing apparatus according to claim 13 further including means for moving said rotatable shaft along its axis.

15. Printing apparatus for marking articles comprising:

(A) conveying means for moving articles along predetermined path;

(B) supply means for supplying said articles to said conveying means;

(C) print means operatively associated with said conveying means downstream of said supply means, and comprising;

(1) a rotatable design roll;

(2) first mounting means for mounting said design roll for rotation about a first horizontal axis;

(3) a rotatable printing roll positioned on a side of the design roll which is opposite to the supply means;

(4) second mounting means for mounting said printing roll for rotation about a second horizontal axis parallel to said first horizontal axis, so that said design roll is positioned between said printing roll and said supply means; and (5) pivot means for:

(a) fixing the position of said first and said second mounting means so that the distance between said first and said second horizontal axes is equal to the radius of said design roll plus the radius of said printing roll, and said rolls make tangential contact with each other, and (b) selectively pivoting said printing roll and said second mounting means about said first horizontal axis between an operative position in which said printing roll is in position to contact articles on said conveying means and a dwell position in which said printing roll is spaced from said conveying means so as not to contact articles on said conveying means; and (D) an ink reservoir positioned directly beneath said design roll and directly over said conveying means;

(E) wherein said means for fixing the position of said first and said second mounting means incorporates means for guiding movement of said ink reservoir to and from the position directly under said design roll and directly above said conveying means, in the general direction of said printing roll, and for permitting said ink reservoir to be removed from said printing apparatus from the side of said design roll which is opposite to the supply means.

16. Printing apparatus according to claim 15 wherein said guiding means comprises a plurality of slots formed in said means for fixing the position of said first and said second mounting means, and a plurality of lugs attached to and extending from said ink reservoir and locatable within said slots.

* * * * *